US007603779B2

(12) United States Patent
Rowlay

(10) Patent No.: US 7,603,779 B2
(45) Date of Patent: Oct. 20, 2009

(54) DOUBLE ENDED KNIFE

(75) Inventor: Stephen Rowlay, Sheffield (GB)

(73) Assignee: The Stanley Works, New Britain, CT (US)

( * ) Notice: Subject to any disclaimer, the term of this patent is extended or adjusted under 35 U.S.C. 154(b) by 526 days.

(21) Appl. No.: 11/222,938

(22) Filed: Sep. 12, 2005

(65) Prior Publication Data

US 2007/0056170 A1 Mar. 15, 2007

(51) Int. Cl.
*B26B 1/08* (2006.01)

(52) U.S. Cl. ..... 30/162; 30/335

(58) Field of Classification Search ..... 30/125, 30/151, 152, 154, 164, 334, 335, 337, 339, 30/286, 287, 299, 304, 155, 158–162
See application file for complete search history.

(56) References Cited

U.S. PATENT DOCUMENTS

| | | | | |
|---|---|---|---|---|
| 110,986 | A * | 1/1871 | Lyman | 30/163 |
| 174,417 | A * | 3/1876 | Evans | 30/162 |
| 3,448,518 | A | 6/1969 | Sklar | |
| 3,660,896 | A | 5/1972 | Umholtz | |
| 4,823,463 | A * | 4/1989 | Lemaire | 30/162 |
| 4,884,307 | A | 12/1989 | Flood | |
| D310,474 | S | 9/1990 | Bartsch et al. | |
| 5,027,516 | A | 7/1991 | Howerton | |
| 5,093,994 | A | 3/1992 | Karas | |
| 5,230,152 | A | 7/1993 | Kennedy | |
| D355,345 | S | 2/1995 | Drust | |
| 5,806,189 | A | 9/1998 | Bailey | |
| 5,906,049 | A | 5/1999 | Butts | |
| 5,960,544 | A | 10/1999 | Beyers | |
| 6,006,433 | A | 12/1999 | Baltazar | |
| 6,148,522 | A | 11/2000 | Dobandi | |
| 6,327,780 | B1 | 12/2001 | Bigham et al. | |
| D473,778 | S | 4/2003 | Hsu | |
| 2005/0050734 | A1 | 3/2005 | Kesinger | |

* cited by examiner

*Primary Examiner*—Phong Nguyen
(74) *Attorney, Agent, or Firm*—Pillsbury Winthrop Shaw Pittman LLP

(57) ABSTRACT

A utility knife and a method of using a utility knife. The utility knife including a first blade coupled to a linkage and movably positioned within the housing between a first blade fully-retracted position wherein all of the first blade is positioned within the housing and a first blade extended position wherein a portion of the first blade extends outside the housing, and a second blade coupled to the linkage and movably positioned within the housing between a second blade fully-retracted position wherein all of the second blade is positioned within the housing and a second blade extended position wherein a portion of the second blade extends outside the housing. Additionally, the linkage being movable between a first position in which the linkage locks the first blade in the fully-retracted position while permitting the second blade to move to the extended position and a second position in which the linkage locks the second blade in the fully-retracted position while permitting the first blade to move to the extended position.

19 Claims, 6 Drawing Sheets

DOUBLE ENDED KNIFE

FIELD OF THE INVENTION

The present invention relates to a utility knife. More specifically, the present application illustrates embodiments of the present invention, including those relating to a dual blade utility knife.

BACKGROUND

Known dual blade utility knives include two blades within one housing. Each blade is capable of being employed for use.

U.S. Pat. No. 5,230,152 to Kennedy and U.S. Pat. No. 6,148,522 to Dobandi, which disclose utility knives, are each incorporated herein in its entirety by reference thereto, respectively.

SUMMARY OF THE INVENTION

One aspect of the invention relates to a utility knife, comprising: a housing; a linkage coupled to the housing; a first blade coupled to the linkage and movably positioned within the housing between a first blade fully-retracted position wherein all of the first blade is positioned within the housing and a first blade extended position wherein a portion of the first blade extends outside the housing; and a second blade coupled to the linkage and movably positioned within the housing between a second blade fully-retracted position wherein all of the second blade is positioned within the housing and a second blade extended position wherein a portion of the second blade extends outside the housing, the linkage being movable between a first position in which the linkage locks the first blade in the fully-retracted position while permitting the second blade to move to the extended position and a second position in which the linkage locks the second blade in the fully-retracted position while permitting the first blade to move to the extended position.

Another aspect of the invention relates to a utility knife, comprising: a housing; a linkage coupled to the housing, the linkage including a first link and a second link; a first blade coupled to the linkage and movably positioned within the housing between a first blade fully-retracted position wherein all of the first blade is positioned within the housing and a first blade extended position wherein a portion of the first blade extends outside the housing; and a second blade coupled to the linkage and movably positioned within the housing between a second blade fully-retracted position wherein all of the second blade is positioned within the housing and a second blade extended position wherein a portion of the second blade extends outside the housing, at least one of the first and second links being movable relative to the other of the first and second links such that the first and second links are movable between a first configuration in which the linkage locks the first blade in the fully-retracted position while permitting the second blade to move to the extended position and a second configuration in which the linkage locks the second blade in the fully-retracted position while permitting the first blade to move to the extended position.

Another aspect of the invention relates to a method of using a utility knife, comprising moving a first blade from an extended position, wherein a portion of the first blade is positioned outside a housing, to a fully-retracted position within the housing, wherein all of the first blade is positioned within the housing, while simultaneously maintaining a second blade in a fully-retracted and locked position wherein all of the second blade is positioned within the housing and the second blade is prohibited from moving out of the fully-retracted and locked position; maintaining the second blade in the fully-retracted and locked position until the first blade is fully-retracted within the housing and positioned in a lockable position; and moving the second blade from the fully-retracted and locked position toward an extended position, wherein a portion of the second blade is positioned outside the housing, the moving of the second blade being possible only while the first blade is in the fully-retractable and lockable position and while simultaneously locking the first blade in the fully-retracted and lockable position after movement of the second blade but prior to any portion of the second blade extending outside the housing.

Other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DESCRIPTION OF ILLUSTRATED EMBODIMENTS

Figure 1:
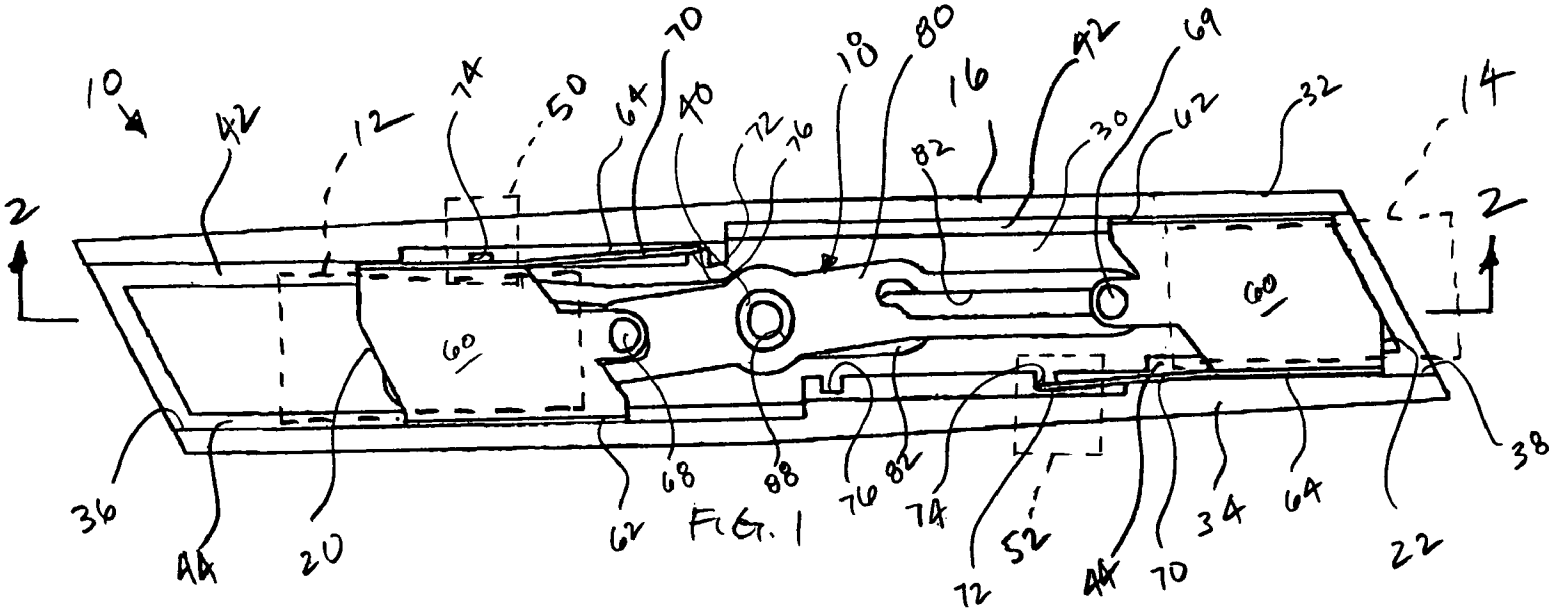
FIG. 1 illustrates a side, elevational view of a utility knife with half of the knife removed to show the inner workings of the knife, in accordance with one illustrated embodiment of the present invention.
Figure 2:
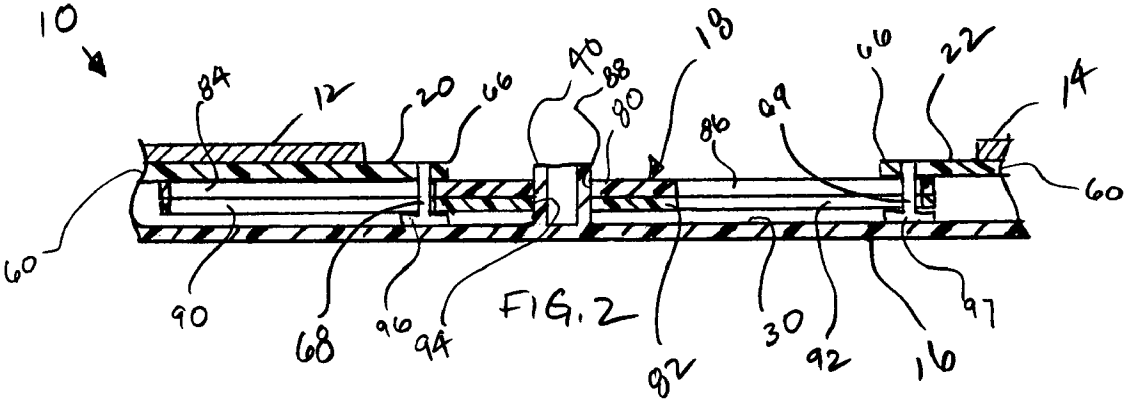
FIG. 2 illustrates cross-sectional view of the knife of FIG. 1 taken along line 2-2 of FIG. 1.

Although other embodiments are possible, one embodiment of the invention is illustrated in FIGS. 1-12. FIGS. 1-12 illustrate a utility knife 10 having both a first blade 12 and a second blade 14 extending from a housing 16. The first and second blades 12 and 14 are connected to each other and to the housing 16 by a linkage 18 that permits each blade 12 and 14 to move independently while only permitting one blade to protrude from the housing 16 at any one time. That is, while the linkage 18 will permit either of the two blades 12 and 14 to extend from the housing 16, only one of the blades 12 and 14 can extend from the housing 16 at one time and prior to the one selected blade extending from the housing 16, the linkage 18 locks the other, nonselected blade within the housing so that no part of the nonselected blade can extend from the housing.

FIG. 1 shows knife 10 comprising housing 16, first blade 12, second blade 14, and linkage 18. The blades 12 and 14 are coupled to linkage 18 via first and second blade holders 20 and 22, respectively. The housing 16 can take a variety of forms and configurations, but may be formed from generally-known plastic or metal material. The housing 16 illustrated in FIG. 1 is molded of plastic material and would typically include a cover (not shown) or be otherwise formed to fully enclose the blades 12 and 14 within the housing 16 when desired. Housing 16 includes a base 30 having sidewalls 32 and 34 and openings 36 and 38 at opposite ends of the housing 16 so that the blades 12 and 14, respectively, can be extended from and retracted into the housing 16. The base 30 has an axle 40 extending therefrom to provide a pivoting mechanism for the linkage 18. The axle 40 may integrally extend from the base 30. The sidewalls 32 and 34 can take various configurations and may include surfaces for guiding the movement of the blades 12 and 14, such as the tracks 42 and 44 illustrated for guiding blade holders 20 and 22, respectively. The housing 16 may also have appropriate openings, for example, in sidewall 32, for locating actuating members 50 and 52 that are accessible from outside the housing 16 so that the blades 12 and 14 may be selectively moved from a retracted position within housing 16 to an extended position outside the housing 16 for use in cutting. Actuating members 50 and 52 are only shown schematically, but typically, such members 50 and 52 are actuated by hand, for example, by pressing the member 50 and 52 by using a thumb or other finger.

Blades 12 and 14 are shown schematically in the drawings and may be conventional knife blades formed of metal or other appropriate material.

Figure 3:
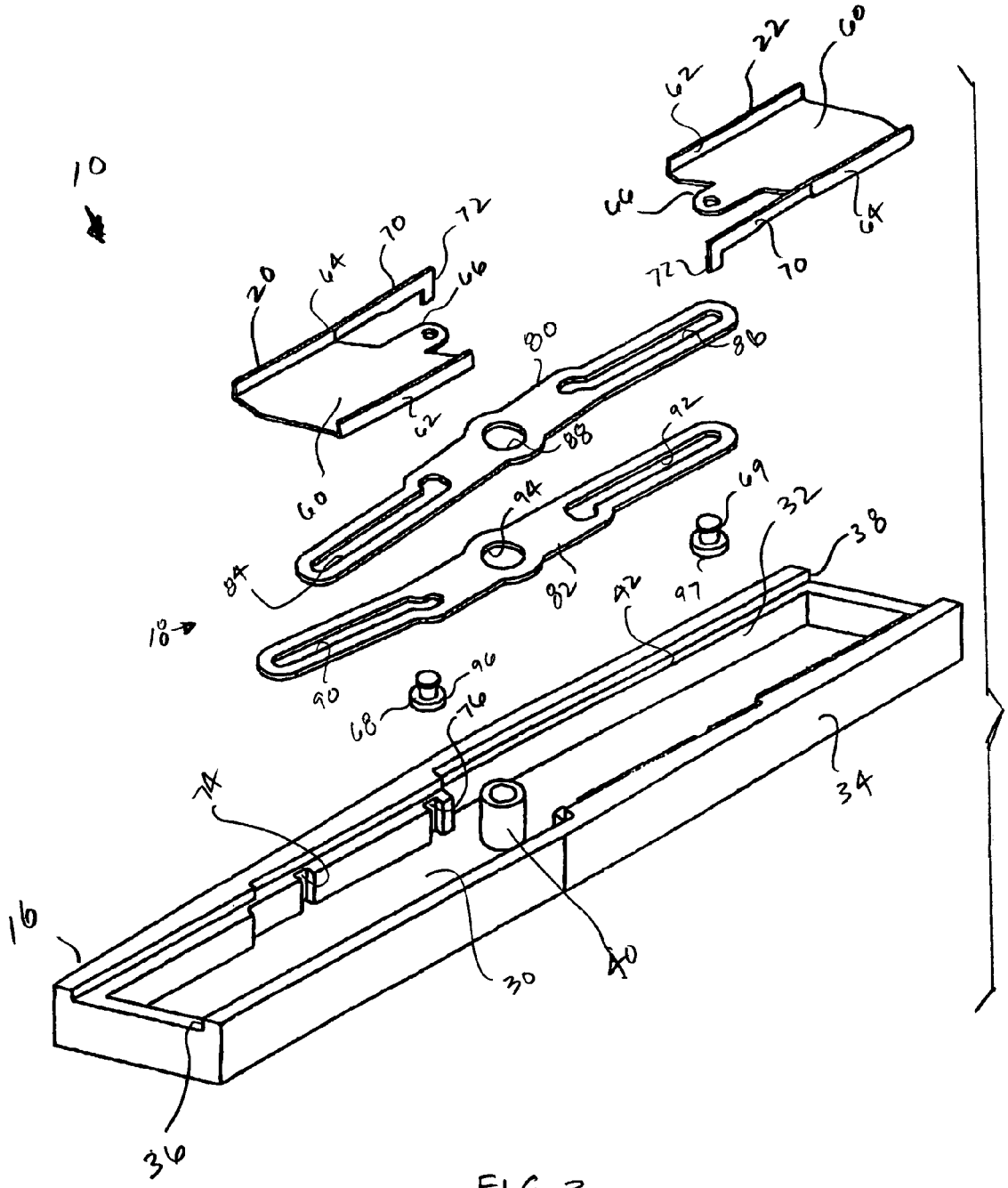
FIG. 3 illustrates an exploded view of the knife of FIG. 1.
Figure 4:
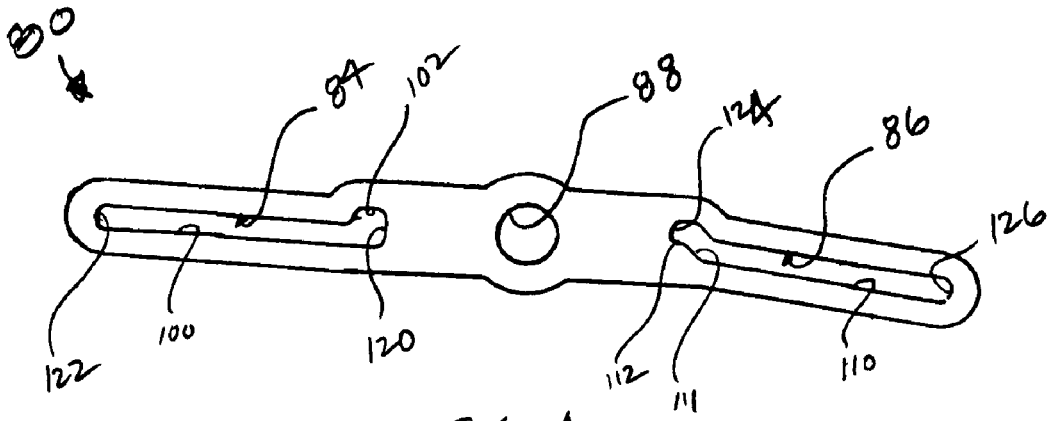
FIG. 4 illustrates one link of the knife of FIG. 1.
Figure 5:
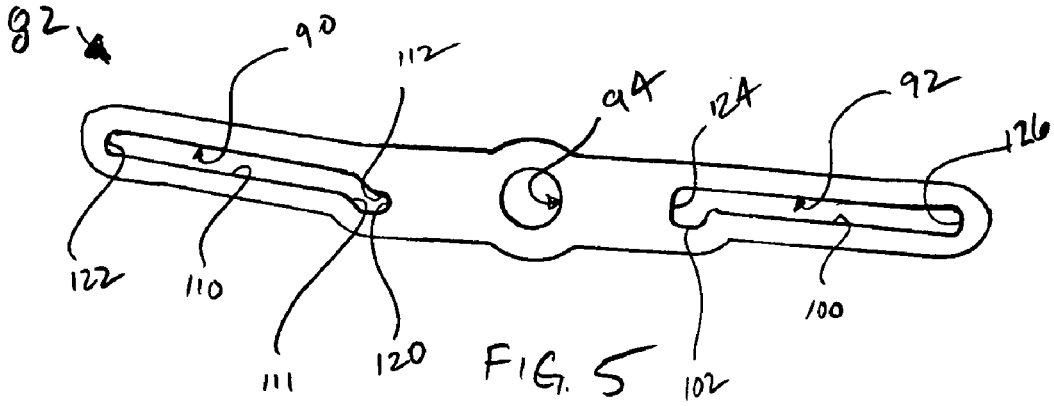
FIG. 5 illustrates another link of the knife of FIG. 1.

First blade 12 is coupled to the linkage 18 by first blade holder 20, and the second blade 14 is coupled to the linkage 18 by the second blade holder 22. Blade holders 20 and 22 may be formed of a variety of materials, such has plastic or metal, and may be formed in a variety of configurations. The blade holders 20 and 22 may also be one-piece, integrally formed or molded elements, or may be formed as an assembly of various parts. As illustrated in FIG. 1, blade holders 20 and 22 are formed as substantially identical blade holders, except for their respective orientation within housing 16. Each blade holder 20, 22 has a main section 60 for receiving a portion of a corresponding blade 12, 14. The main section 60 may include side lips 62 and 64 for extending around the sides of a blade. The main section 60 may include a substantially flat section to abut a corresponding substantially flat portion of a corresponding blade 12, 14. Main section 60 may also included other known mechanisms for releasably securing a blade to a blade holder so that the blade can be securely connected to the holder 20, 22, but may be easily replaced if the blade becomes worn or damaged. For example, the blade holders 20 and 22 may include a projection that fits into a corresponding depression or hole in a blade 12, 14. Blade holders 20, 22 may also include mechanism to lock the holders 20, 22 in the retracted position and/or in the extended position. For example, as seen in FIGS. 1 and 3, each blade holder 20, 22 includes a leaf spring 70 with an end 72. When the blade 14 and corresponding blade holder 22 are in an extended position (as show in FIG. 1 for blade holder 22), the end 72 of the spring 70 may be biased by the spring 70 into a notch 74 in the side of housing 16 to lock the holder 22 and its blade 14 in the extended position with respect to the housing 16. At the same time, when the blade 14 and corresponding blade holder 20 are in the retracted position (as show in FIG. 1 for blade holder 20), the end 72 of the spring 70 may be biased by the spring 70 into a notch 76 in the side of housing 16 to lock the holder 20 and its blade 12 in the retracted position with respect to the housing 16. Each spring end 72 may be selectively moved out of a notch 74, 76 by a corresponding actuating member 50, 52, or other member that is configured to selectively push the respective leaf spring 70 toward the interior of the housing 16 to release the end 72 from a notch 74, 76 and permit the respective blade 12, 14 and holder 20, 22 to move relative to the housing 16 again.

At an interior end of each blade holder 20 and 22, an ear 66 projects from the main section 60 and provides an opening for a pin 68, 69, respectively, which directly connects the respective blade holder 20, 22 to the linkage 18. Each pin 68, 69 may be a separate element, as illustrated, or be integrally formed with the ear 66. Each pin 68, 69 may be made of any appropriate material, such as metal or plastic.

As seen in FIG. 1, linkage 18 couples the blades 12 and 14 to the housing 16 and provides the coupling between the blade holders 20 and 22 and the axel 40 of housing 16. The linkage 16 is preferably designed so that the blades 12, 14 are independently movable from retracted to extended positions and so that only one blade 12, 14 can extend outside the housing 16 at any one time. Although various configurations can be employed, the illustrated linkage 16 includes a first link 80 and a second link 82, which are substantially identical to each other, but which are oriented differently within housing 16. That is, the bottom link 82, as seen in the Figures, is rotated 180 degrees with respect to the top link 80 (see, for example, FIGS. 3, 4, and 5). The links 80 and 82 may be made of a variety of materials, such as plastic or metal, and are substantially rigid to accomplish the appropriate locking of one of the pins 68 and 69, as desired, and as described herein. When assembled on axle 40, the links 80 and 82 are cable of moving about axle 40 and about axle 40 with respect to each other. Once positioned on axle 40, the links 80 and 82 may be kept on axle 40 by the portion of the housing enclosing the housing, such as by a removable cover (not shown).

The first link 80 includes a first linkage slot 84, a second linkage slot 86, and an axle hole 88 for receiving axle 40. The second link 82 includes a third linkage slot 90, a fourth linkage slot 92, and an axle hole 94 for receiving axle 40. As first link 80 is substantially identical to second link 82 (although oriented on axle 40 in a different way), first slot 84 is substantially identical to fourth slot 92, and second slot 86 is substantially identical to third slot 90. Each link 80 and 82 fits around axle 40 via the respective hole 88 and 94 and is capable of pivoting separately about the axle 40.

The first slot 84 and the third slot 90 receive first pin 68, which is coupled to the first blade holder 20, and the second slot 86 and fourth slot 92 receive second pin 69 coupled to the second blade holder 22. Each of the pins 68 and 69 may include a head 96 and 97 on one end, respectively, and be rigidly secured to its respective blade holder 20, 22 on the opposite end to permit the pins 68, 69 to move freely within their respective slots 84, 86, 90, 92 while being secured from leaving their respective slots.

Each of the first and second links 80, 82 pivots around axle 40, which is coupled to the housing 16, and the first line 80 and second link 82 are shaped and configured such that when the first slot 84 and third slot 90 align, the first pin 68 slidably moves along the first and third slots 84, 90, while, at the same time, the second slot 86 and the fourth slot 92 are misaligned such that the second pin 69 is prohibited from moving along the second slot 86 and the fourth slot 92.

To achieve the desired interaction between the links 80 and 82, each of slots 84 and 92 has an elongated section 100, and an off-set section 102. Each of slots 86 and 88 has an elongated section 110, an angle section 111, and an off-set section 112. The links 80 and 82 work in conjunction with each other in that slots 84 and 90 interact together with pin 68, while links 82 and 92 interact together with pin 69. Each of slots 84 and 90 have a common inner end 120 and a common outer end 122, and each of slots 86 and 88 have a common inner end 124 and a common outer end 126. The inner ends 120 and 124 are adjacent the axle 40 and the outer ends 122 and 126 are opposite to the inner ends 120 and 124 and remote from the axle 40.

Figure 6:
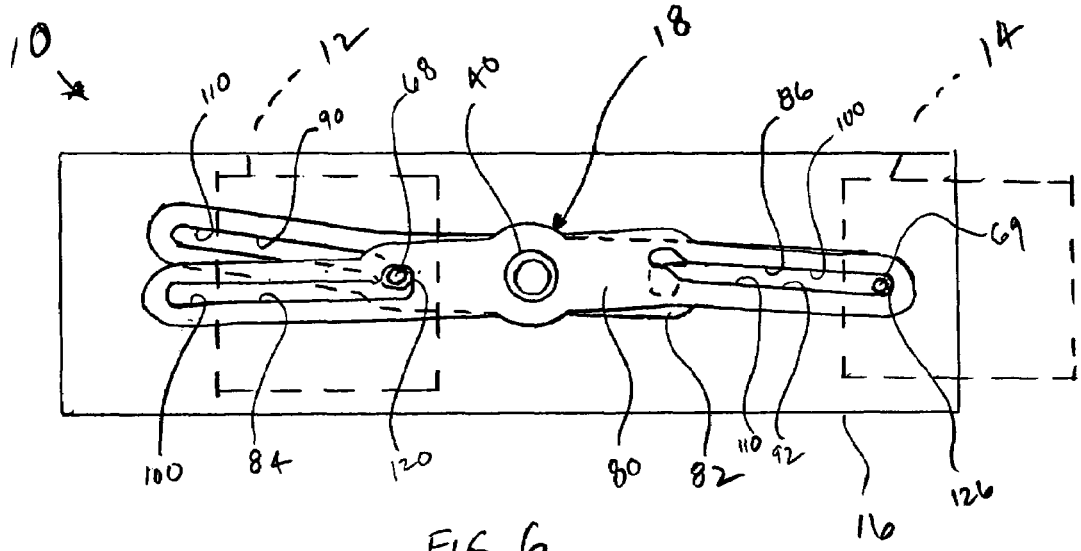
FIG. 6 illustrates a schematic of the interaction of the linkage of FIG. 1 with one blade in a fully-extended position and the other blade in a locked and fully-retracted position.

As seen in FIG. 6, the first and second links 80 and 82 are structured and arranged such that the second slot 86 and fourth slot 92 may align and the second pin 69 can slidably move along the second and fourth slots 86, 92 to their outer end 126 so that blade 14 can extend out of housing 16 and be available for use. However, the pin 69 (and, thus, the blade 14) only slides along slots 86 and 92 when the first pin 68 (and, thus, the blade 12) is positioned at the inner end 120 of the first and third slots 84 and 90. As seen in FIG. 6, the first and second links 80 and 82 have each pivoted about the axle 40 in opposite directions and the slots 84 and 90 have misaligned so that the first pin 68 cannot leave the inner end 120. Thus, while blade 14 is available for use and extends out from the housing 16 as seen in FIG. 6, the blade 12 is fully retracted within the housing 16 and cannot leave the housing 16.

FIGS. 7-12 illustrate the movement of the links 80 and 82 to permit the blade 14 to be retracted into the housing 16 to a fully-retracted position and to then permit the blade 12 to be moved out of the housing 16 to a fully extended position wherein the blade 12 is available for use.

Figure 7:
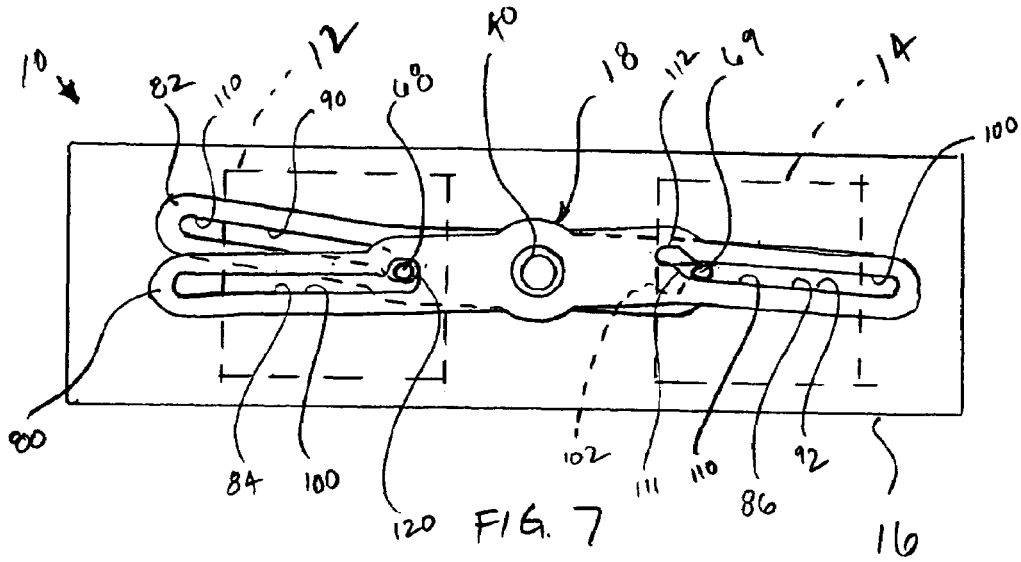
FIG. 7 illustrates a schematic of the interaction of the linkage of FIG. 1 with one blade moving toward a lockable position and the other blade in a locked and fully-retracted position.

In FIG. 7, as the blade 14 is retracted within the housing 16 (for example, by releasing the end 72 from its notch 74 and manually pushing the blade 14 within the housing by appropriately pushing actuating member 52) and the pin 69 moves from the outer end 126 toward the inner end 124, the links 80 and 82 make no substantial movement since the elongated section 110 of slot 82 and the elongated section 100 of slot 92 are aligned.

Figure 8:
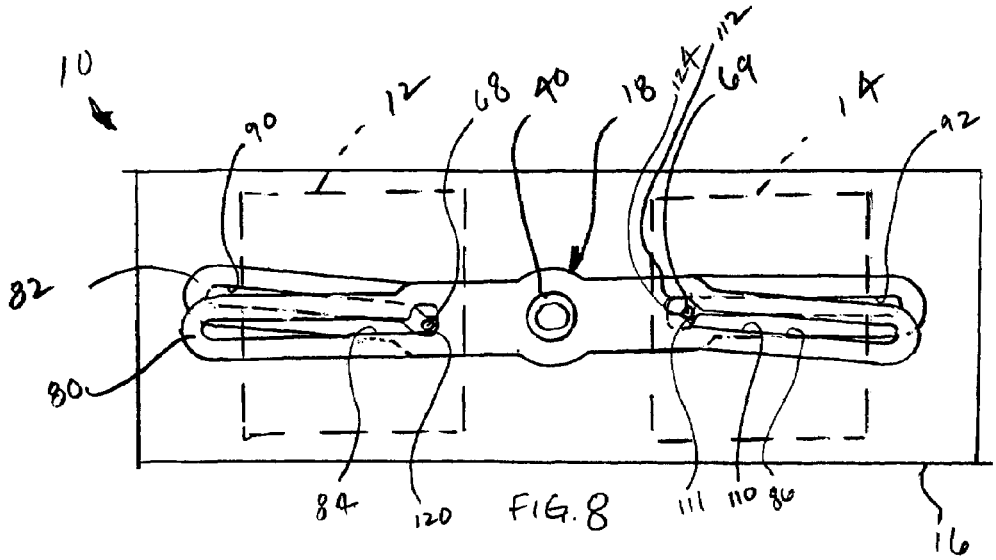
FIG. 8 illustrates a schematic of the interaction of the linkage of FIG. 1 with one blade moving toward a lockable position and the other blade in a locked and fully-retracted position.

In FIG. 8, as the second pin 69 is forced further toward the inner end 124 (for example, by further pushing actuating member 52), the pin 69 abuts the edges of slots 86 and 92 and forces rotation of the links 80 and 82 about axle 40 to create a misalignment between slots 86 and 92 as well as between slots 90 and 88 as the second pin 69 moves from the elongated section 110 to the angled section 111 of slot 86. However, the first pin 68 remains "locked" at the inner end 120 of slots 84 and 90.

Figure 9:
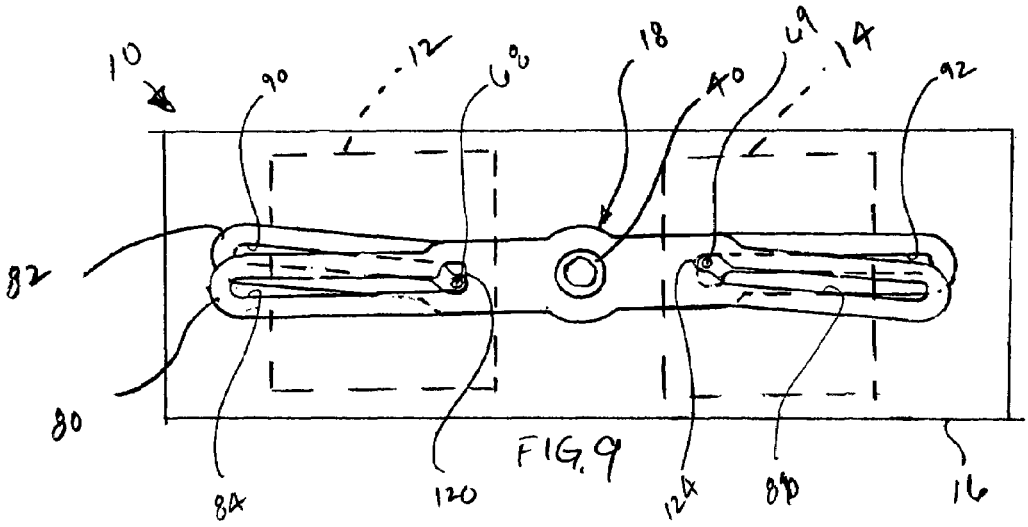
FIG. 9 illustrates a schematic of the interaction of the linkage of FIG. 1 with both blades being in a lockable and fully-retracted position.

In FIG. 9, the second pin 69 has finished the forced rotation of the links 80 and 82 and has completed its travel through the slots 86 and 92 (for example, by still further pushing of the actuating member 52) and is positioned at the inner end 124 in a fully retracted position. At this point, although the first pin 68 (and first blade 12) is also in a fully retracted position at inner end 120, the first pin 68 is now "unlocked" and may proceed to the outer end 122 of slots 84 and 90. In fact, at this point, either one of blades 12 or 14 may be selected for use in a fully extended position. Also, at this point, the end 72 of blade holder 20 may be biased into its respective retracted notch 76 to further keep the blade 14 in the fully retracted position.

Figure 10:
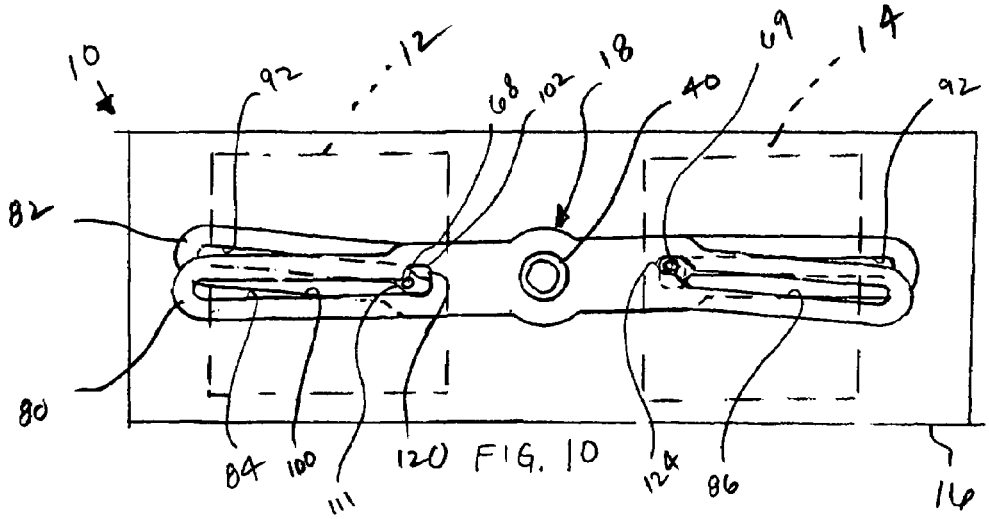
FIG. 10 illustrates a schematic of the interaction of the linkage of FIG. 1 with one blade in a fully-retracted and locked position and the other blade moving out of the locked and fully-retracted position.
Figure 11:
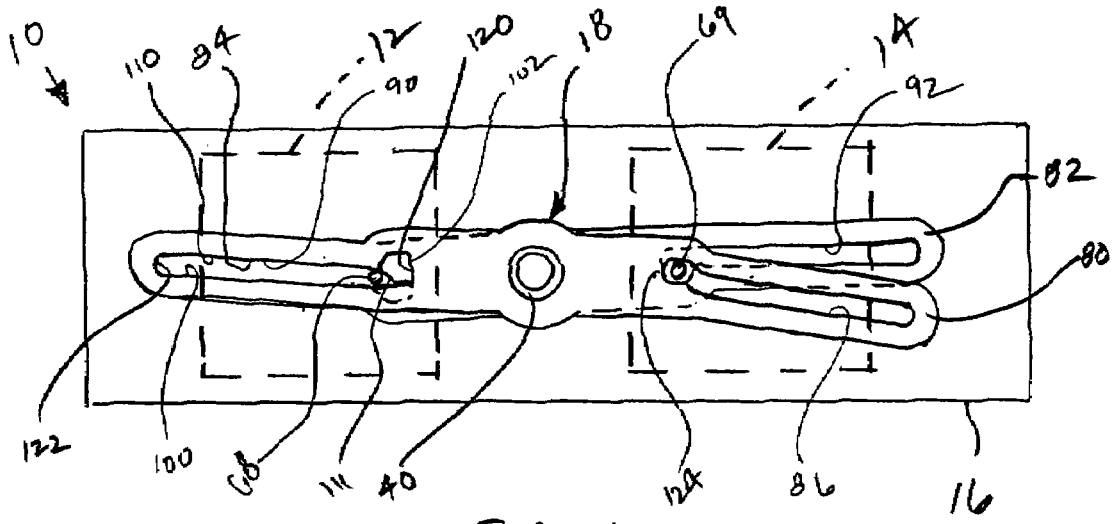
FIG. 11 illustrates a schematic of the interaction of the linkage of FIG. 1 with one blade in a fully-retracted and locked position and the other blade moving out of the locked and fully-retracted position.
Figure 12:
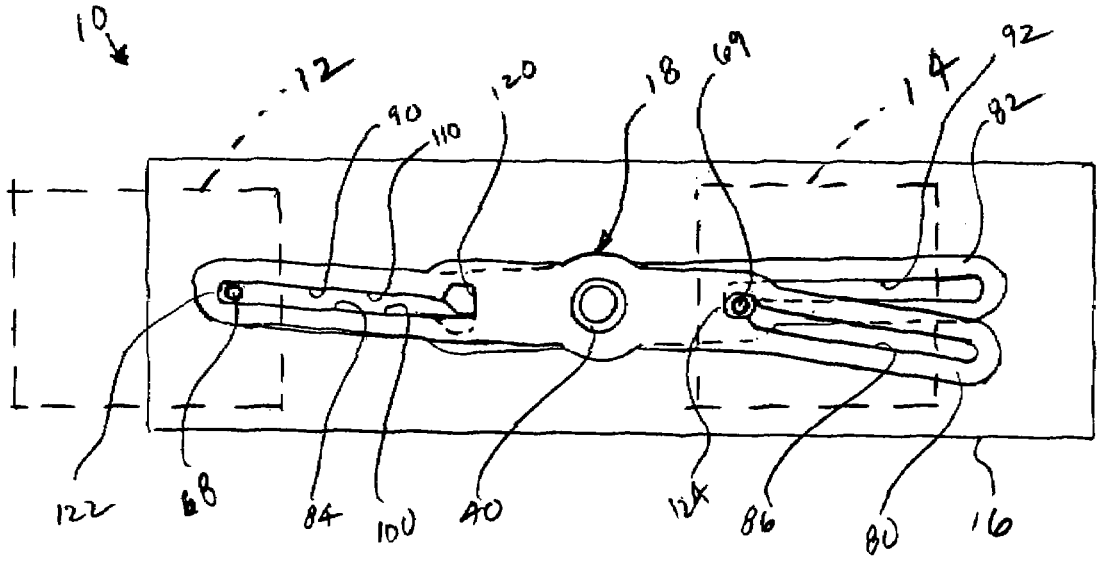
FIG. 12 illustrates a schematic of the interaction of the linkage of FIG. 1 with one blade in a locked and fully-retracted position and with the other blade in a fully-extended position.

In FIGS. 10-12 the movement described in FIGS. 6-8 is reversed so that the first blade 12 may be fully extended outside the housing 16 while the second blade 14 remains locked in the housing 16. In FIG. 10, the first pin 68 is pushed out from the inner end 120 toward the outer end 122 and into angled section 111 of slot 90. In so doing, as the first pin 68 moves, the first pin 68 abuts the edges of slots 84 and 90 and begins to move the slots 84 and 90 toward alignment as the links 80 and 82 are forced to rotate about axle 40. At the same time, the rotation of the links 80 and 82 locks second pin 69 at the inner end 124 since the second pin 69 cannot now be forced away from its inner end 124 due to the rigidity of the links 80 and 82 and location of first pin 68 out from the inner end 120.

In FIG. 11, the first pin 68 has been further moved toward the outer end 122 and caused further rotation of the links 80 and 82 about axle 40 so that the elongated section 100 of slot 84 and the elongated section 110 of slot 90 are aligned.

In FIG. 12, now that the elongated section 100 of slots 84 and the elongated section 110 of slot 90 are aligned, the first pin 68 (and the first blade 12) can be moved along the slots 84 and 90 to the outer end 122. At this point, the blade 12 is in the fully extended position and at least a portion of the blade 12 extends out from the housing 16 for possible use. The end 72 of spring 70 of blade holder 20 may also be biased into its respected notch 74 to further maintain the blade 12 in the extended position. Meanwhile, the blade 14 remains locked in the fully-retracted position at inner end 124. The structure of the slots is preferably formed so that at no time can any portion of one blade extend outside of the housing 16 unless the other blade is fully retracted and locked within the housing 16 at the innermost section of their respective slots. Of course, the procedure shown in FIGS. 6-12 and described herein can be repeated for the extension or retraction of either blade 12 or 14.

The foregoing embodiments have been provided to illustrate the structural and functional principles of the present invention, and are not intended to be limiting. To the contrary, the present invention is intended to encompass all modifications, alterations, and substitutions within the scope of the appended claims.

What is claimed is:

1. A utility knife, comprising:

a housing;

a linkage coupled to said housing;

a first blade coupled to said linkage and movably positioned within said housing between a first blade retracted position wherein all of said first blade is positioned within said housing and a first blade extended position wherein a portion of said first blade extends outside said housing; and a second blade coupled to said linkage and movably positioned within said housing between a second blade retracted position wherein all of said second blade is positioned within said housing and a second blade extended position wherein a portion of said second blade extends outside said housing, said linkage being movable between a first position in which said linkage locks said first blade in said first blade retracted position while said second blade moves between said second blade retracted position and said second blade extended position and a second position in which said linkage locks said second blade in said second blade retracted position while said first blade moves between said first blade retracted position and said first blade retracted position extended position.

2. A utility knife according to claim 1, wherein said first blade is coupled to said linkage by a first blade holder, and said second blade is coupled to said linkage by a second blade holder.

3. A utility knife according to claim 1, wherein said linkage includes a first slot for receiving a first pin coupled to said first blade and a second slot for receiving a second pin coupled to said second blade.

4. A utility knife according to claim 1, wherein said linkage includes a first link and a second link.

5. A utility knife according to claim 4, wherein said first link includes a first slot and a second slot.

6. A utility knife according to claim 5, wherein said second link includes a third slot and a fourth slot.

7. A utility knife according to claim 6, wherein said first and third slots receive a first pin coupled to said first blade and said second and fourth slots receive a second pin coupled to said second blade.

8. A utility knife according to claim 4, wherein each of said first and second links pivots around an axle, which is coupled to said housing.

9. A utility knife according to claim 7, wherein each of said first and second links pivots around an axle, which is coupled to said housing, and said first and second links are constructed and arranged such that when said first and third slots align, said first pin slidably moves along said first and third slots and said second and fourth slots are misaligned such that said second pin is prohibited from moving along said second and fourth slots.

10. A utility knife according to claim 9, wherein each of said first and second slots has an inner end adjacent said axle and an outer end opposite to said inner end and remote from said axle, and said first and second links being structured and arranged such that said second and fourth slots align and said second pin slidably moves along said second and fourth slots from said inner end of said second slot to said outer end of said second slot only when said first pin is positioned at said inner end of said first slot.

11. A utility knife, comprising:

a housing;

a linkage coupled to said housing, said linkage including a first link and a second link;

a first blade coupled to said linkage and movably positioned within said housing between a first blade retracted position wherein all of said first blade is positioned within said housing and a first blade extended position wherein a portion of said first blade extends outside said housing; and a second blade coupled to said linkage and movably positioned within said housing between a second blade retracted position wherein all of said second blade is positioned within said housing and a second blade extended position wherein a portion of said second blade extends outside said housing, at least one of said first and second links being movable relative to the other of said first and second links such that said first and second links are movable between a first configuration in which said linkage locks said first blade in said first blade retracted position while said second blade moves between said second blade retracted position and said second blade extended position and a second configuration in which said linkage locks said second blade in said second blade retracted position while said first blade moves between said first blade retracted position and said first blade extended position.

12. A utility knife according to claim 11, wherein each of said first and second linkage includes a first slot for receiving a first pin coupled to said first blade and further includes a second slot for receiving a second pin coupled to said second blade.

13. A utility knife according to claim 11, wherein each of said first and second links pivots around an axle, which is coupled to said housing.

14. A utility knife according to claim 11, further comprising:

first means for attaching said first blade to said linkage and second means for attaching said second blade to said linkage.

15. A utility knife according to claim 11, wherein said first link includes a first slot and a second slot.

16. A utility knife according to claim 15, wherein said second link includes a third slot and a fourth slot.

17. A utility knife according to claim 16, wherein said first and third slots receive a first pin coupled to said first blade and said second and fourth slots receive a second pin coupled to said second blade.

18. A utility knife according to claim 17, wherein each of said first and second links pivots around an axle, which is coupled to said housing, and said first and second links are constructed and arranged such that when said first and third slots align, said first pin slidably moves along said first and third slots and said second and fourth slots are misaligned such that said second pin is prohibited from moving along said second and fourth slots.

19. A utility knife according to claim 18, wherein each of said first and second slots has an inner end adjacent said axle and an outer end opposite to said inner end and remote from said axle, and said first and second links being structured and arranged such that said second and fourth slots align and said second pin slidably moves along said second and fourth slots from said inner end of said second slot to said outer end of said second slot only when said first pin is positioned at said inner end of said first slot.

* * * * *